US005122628A

United States Patent [19]

McLelland et al.

[11] Patent Number: 5,122,628

[45] Date of Patent: Jun. 16, 1992

[54] SUDDEN PRESSURE RISE DETECTOR

[75] Inventors: Bruce McLelland; Robert L. DeGood, both of Blue Springs, Mo.; James M. Norman, Lenexa, Kans.

[73] Assignee: Fike Corporation, Blue Springs, Mo.

[21] Appl. No.: 529,180

[22] Filed: May 25, 1990

[51] Int. Cl.[5] ..... H01H 35/34

[52] U.S. Cl. ..... 200/83 Y; 92/5 R; 73/717; 200/81.5; 200/83 W

[58] Field of Search ..... 92/5 R; 137/551, 557; 73/716, 717, 723, 745; 200/81 R, 81.4, 81.5, 302.1, 83 R, 83 B, 83 J, 83 D, 83 Y, 83 S, 83 W, 83 SA; 340/611, 626

[56] References Cited

U.S. PATENT DOCUMENTS

| | | | |
|---|---|---|---|
| 801,922 | 10/1905 | Shafer . | |
| 1,829,807 | 11/1931 | McMurrin . | |
| 2,359,168 | 9/1944 | Somes et al. . | |
| 2,579,334 | 12/1951 | Plank . | |
| 2,645,248 | 7/1953 | Baker | 92/97 |
| 2,719,889 | 10/1955 | Miller . | |
| 2,799,781 | 7/1957 | Joyce . | |
| 3,091,676 | 5/1963 | Koster . | |
| 3,240,894 | 3/1966 | Mansfield, Jr. et al. . | |
| 3,398,991 | 8/1968 | Compton . | |
| 3,591,051 | 7/1971 | Mitchell . | |
| 3,609,364 | 9/1971 | Paine . | |
| 3,634,639 | 1/1972 | Jilbert . | |
| 3,636,288 | 1/1972 | Russell . | |
| 3,646,774 | 3/1972 | Werner . | |
| 3,698,323 | 10/1972 | Apstein et al. . | |
| 3,716,717 | 2/1973 | Scheidweiler et al. . | |
| 3,717,734 | 2/1973 | Wertheimer | 200/83 R |
| 3,719,939 | 3/1973 | Geil et al. . | |
| 3,742,166 | 6/1973 | Schaefer . | |
| 3,752,942 | 8/1973 | McAfee . | |
| 3,786,211 | 1/1974 | Popp . | |
| 3,810,141 | 5/1974 | Pferd et al. . | |
| 3,825,754 | 7/1974 | Cinzori et al. . | |
| 3,835,271 | 9/1974 | Garrett . | |
| 3,850,037 | 11/1974 | Lawford et al. . | |
| 3,852,547 | 12/1974 | Dietz . | |
| 3,946,176 | 3/1976 | Goff et al. . | |
| 3,984,649 | 10/1976 | Bauer et al. . | |
| 3,989,911 | 11/1976 | Perry | 303/7 |
| 4,081,636 | 3/1978 | Rice | 200/83 Y |
| 4,084,072 | 4/1978 | Tsubota et al. . | |
| 4,090,048 | 5/1978 | Brightman . | |
| 4,091,249 | 5/1978 | Huffman . | |
| 4,104,495 | 8/1978 | Jones et al. . | |
| 4,140,045 | 2/1979 | Hardwick et al. . | |
| 4,172,412 | 10/1979 | Sepso . | |
| 4,184,674 | 1/1980 | Wirz | 271/260 |
| 4,242,082 | 12/1980 | Branson et al. . | |
| 4,242,083 | 12/1980 | Demi . | |
| 4,243,374 | 1/1981 | Demi . | |
| 4,267,889 | 5/1981 | Williams . | |
| 4,280,058 | 7/1981 | Tar . | |

(List continued on next page.)

FOREIGN PATENT DOCUMENTS

| | | |
|---|---|---|
| 636289 | 2/1962 | Canada . |
| 697112 | 11/1964 | Canada . |

*Primary Examiner*—Gerald P. Tolin

*Attorney, Agent, or Firm*—Hovey, Williams, Timmons & Collins

[57] ABSTRACT

Apparatus for detecting a sudden rise in pressure of a source thereof is disclosed which is especially useful for activating explosion suppression or isolation equipment by virtue of the fact that the apparatus is capable of detecting a sudden, incipient rise in pressure in a containment system which could result in a destructive overpressure in the system. The sudden pressure detection apparatus is provided with a housing having a pair of opposed passages defining fluid inlets closed with deflectable diaphragm means interconnected by a rod assembly having means thereon for operating a switch which controls activation of the suppression or isolation equipment. One of the housing inlets is adapted to be coupled to the source of system pressure. A pressure equalization conduit extends between and intercommunicates the housing passages to equalize the pressure on the diaphragm means. Restriction means within the path limits the rate at which equalization occurs so that the diaphragm means deflect and actuate the switch upon sensing of a sudden overpressure.

15 Claims, 2 Drawing Sheets

U.S. PATENT DOCUMENTS 4,323,742 4/1982 Priest .
4,400,601 8/1983 Brucken .
4,401,976 8/1983 Stadelmayr .
4,414,542 11/1983 Farguhar et al. .
4,423,326 12/1983 Ball .
4,433,219 2/1984 Dietz .
4,441,357 4/1984 Kahn et al. .
4,472,715 9/1984 Kern et al. .
4,473,729 9/1984 Ting et al. .
4,497,373 2/1985 Farguhar .
4,503,301 3/1985 Kurtz .
4,514,604 4/1985 Gmeinder et al. .
4,520,245 5/1985 Ochsner .
4,532,390 6/1985 Gallone .
4,553,031 11/1985 Cholin et al. .
4,605,832 8/1986 Koopmann ..... 200/83 D
4,633,213 12/1986 Venema .
4,668,889 5/1987 Adams .
4,702,322 10/1987 Richardson .
4,718,497 1/1988 Moore et al. .
4,719,973 1/1988 Allen .
4,722,766 2/1988 Spring .
4,743,716 5/1988 Tsukioka ..... 200/83 Y
4,788,867 12/1988 Kishel .
4,840,068 6/1989 Mayhew, Jr. .

SUDDEN PRESSURE RISE DETECTOR

BACKGROUND OF THE INVENTION

1. Field of the Invention

This invention relates to apparatus for detecting a sudden rise in pressure of a source thereof. In particular, it relates to apparatus capable of detecting a sudden incipient rise in pressure in a containment system which could result in a destructive overpressure in that system.

Low strength containment and process vessels used in dust collectors, process equipment, dryers, ovens, mills, bucket elevators, storage bins, hoppers and similar devices are subject to catastrophic destruction if an explosion occurs in the vessel or adjacent conveying ducts or pipes, or associated processing units.

Because of normal pressure fluctuations that occur within the containment vessel, it has heretofore been difficult to effectively distinguish between the incipient rise in pressure within the containment system or associated units which signals the onset of an explosion, thus necessitating activation of explosion suppression or isolation equipment, as compared with the pressure fluctuations that may occur during normal operation of the system.

2. Description of the Prior Art

A number of different industrial processes have containment systems which receive material for collection for further processing. For example, hammermills, solid material grinders, and similar comminuters for products used in the agricultural, horticultural, food or chemical fields are provided with collectors or filter devices for preventing small particles from being discharged into the surrounding atmosphere. Bag houses containing cloth filters have long been used to remove particulate materials from product conveying air before it is discharged into the air. These bag houses have wall structure which protects the surrounding atmosphere but the containment area is of low strength.

Similarly, cyclones for separating larger particles from air streams are of relatively thin wall construction because the normal pressure contained therein is not above atmospheric to a significant degree.

Other collection and containment systems have similar low strength surrounding or containing wall structures. They are designed for the functional purpose of maintaining an air stream under control while particulate material is either removed from the air, or conveyed to another processing area in the air stream.

In instances where a containment system of the type described is connected to downstream processing units, there is always a danger of an explosion which can cause catastrophic over pressures which at the very least destroy the containment vessel or facility. In certain instances, disastrous fires may occur, surrounding peripheral equipment may be subjected to dangerous shock waves, and adjacent workers may even be injured.

Explosion protection systems have previously been provided for protecting containment vessels against catastrophic explosions, but their ability to sense an explosion early in its inception has been somewhat limited because of the need to set the over pressure sensing limit at a level which prevents false alarms or suppression activations as a result of normal pressure fluctuations which occur in the containment system.

The present invention utilizes a dual diaphragm, differential pressure switch of the type used for many years in various applications where the pressure in one part of a processing system may vary relative to the pressure in another part of the system.

Differential pressure sensors per se are not new. Shaffer in U.S. Pat. No. 801,922 discloses a dual diaphragm differential pressure switch as a part of an automatic fire sprinkler system.

In Shaffer, a rod extends between opposed diaphragms and supports a finger which when moved by deflection of the diaphragms operates a control switch. Actuation of the switch initiates an alarm at a central station whenever the equilibrium in the distribution piping of the system is disturbed, either in response to a higher than normal water pressure, or decrease in pressure below a fixed level by virtue of a leak in the piping. However, Shaffer's dual diaphragm pressure switch is not insensitive to normal pressure fluctuations in the sprinkler system.

Compton in U.S. Pat. No. 3,398,991 discloses an automatic vehicle control system which is described as preventing overturning of the vehicle on sharp curves. The centrifugal force detecting, anti-overturn system is sensitive to centrifugal force and is operable to apply braking force to the individual wheels when a vehicle is in a precarious leaning position.

Somes, et al. in U.S. Pat. No. 2,359,168 describe a flow responsive device designed to control operation of an electric switch. A movable member responsive to pressure variations in the flow of fluid through an associated conduit shift the actuating member of an electric switch in accordance with flow conditions within the conduit. The patentees' unit is said to be especially useful for processes involving heat treating of metals by electromagnetic heating and subsequent quenching, where the heating and cooling must be accurately coordinated and controlled. To do so, the flow of hot and cold fluids are sensed and a proper balance maintained therebetween.

U.S. Pat. No. 2,645,248 to Baker discloses a differential pressure device capable of responding to an overpressure condition. The Baker patent seeks to minimize the spacing between opposed diaphragms to decrease the size of the unit and the number of parts required to determine the pressure differential between different sources of pressure.

Rice in U.S. Pat. No. 4,081,636 describes a differential pressure cut-out switch for monitoring the lubrication oil pressure in a sealed refrigeration system compressor. The switch has a low pressure operating point assembly connected to the crank case and a high pressure operating point assembly communicating with the oil pump. A contactor switch unit in the nature of a sensor controller is movable to a first position to provide an open circuit and a second position connecting a resistance of a finite value in the control circuit as a function of the difference between the two system pressures. The differential pressure cutout switch when employed with the sensor controller enables distinguishment between adequate, marginal and inadequate lube oil pressure.

Canadian Pat. No. 636,289 describes an electro-pneumatic differential pressure switch system for automatically operating electrical switches with high switch sensitivity. The system is designed to effect operation of the switches over a wide range of differentially opposed pressures, but as a result of a very small pressure difference. Canadian Pat. No. 697,112 describes a pressure control switch for aircraft wherein the switch is actuated when there is a predetermined relationship between dynamic pressure measured by a pitot minus the static pressure. An aircraft mach number speed therefore may be expressed as a function of the ratio of the differential pressure and the static pressure. In order to obtain the required relationship, diaphragms are used to define three pressure containing areas.

SUMMARY OF THE INVENTION

The sudden pressure rise detector of the present invention is especially adapted for controlling the operation of explosion suppression or isolation equipment which protects limited strength containment vessels or structures forming a part of processing equipment involving low pressure fluid flow streams such as air containing particulate materials or the like. These systems are susceptible to fires and explosions causing destructive overpressures to quickly develop which can have catastrophic results.

The detector has a closed housing provided with a pair of passages defining fluid inlets with one of the inlets being connected directly to the containment system for sensing of the pressure condition therein. A pair of spaced, parallel diaphragms are mounted within the detector housing in closing relationship to the fluid inlets. A rod assembly interconnecting adjacent faces of the diaphragms is movable in response to deflection of the diaphragms. A switch actuator carried by the rod assembly is positioned to operate the actuating arm of an electrical switch within the housing.

A conduit interconnects the fluid inlets of the housing at points outboard of respective diaphragms to equalize the pressure thereon from the containment system. The conduit is configured to present restriction means which limits the rate at which equalization of pressure on opposed diaphragms may occur.

The sudden rise pressure detector is therefore adapted to detect the pressure within the containment system or associated piping leading to or away from such system. The pressure equalization conduit serves to equalize the pressure on opposite faces of the diaphragms even though there are pressure fluctuations in the containment system or the fluid conveying structures associated therewith. However, in the event of a fire or explosion which causes a sudden rise in pressure within the containment system including its supply and delivery piping, the pressure rise is immediately sensed by one of the diaphragms causing deflection thereof, but not the other diaphragm because the equalization conduit path restricts flow of fluid therethrough to an extent that there is a differential pressure created across the two diaphragms. As a result, the electrical switch is actuated to activate the explosion suppression or isolation apparatus.

DETAILED DESCRIPTION OF THE PREFERRED EMBODIMENT

Figure 2:
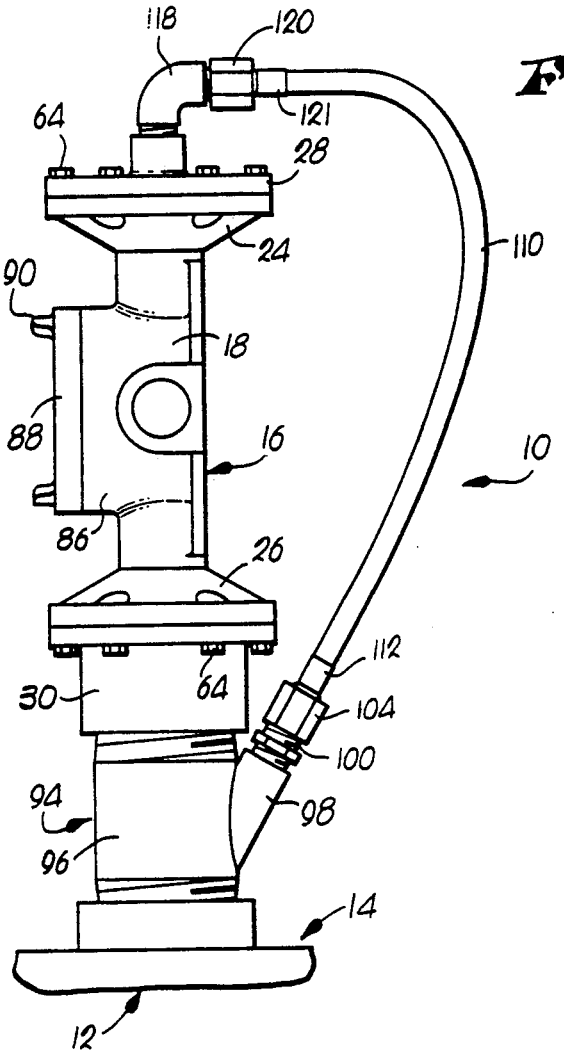
FIG. 2 is a side elevational view of the detector and fragmentary system illustrated in FIG. 1.

The sudden pressure rise detector 10 is adapted to be mounted on one of the components 12 of a low pressure containment system 14 forming a part of a processing system which for example may consist of a dust collector, cyclone, food processor, dryer, oven, hammermill, grinder, bucket elevator, storage bin, or hopper.

Detector 10 has a housing 16 made up of a main generally cylindrical hollow body 18 having opposed circular cavities which receive respective tubular extensions 20 and 22 projecting radially from the body 18 in opposite directions therefrom. Extensions 20 and 22 have conical flange portions 24 and 26 respectively while apertured end fittings 28 and 30 are positioned on the outer surfaces of flanges 24 and 26 respectively.

Figure 4:
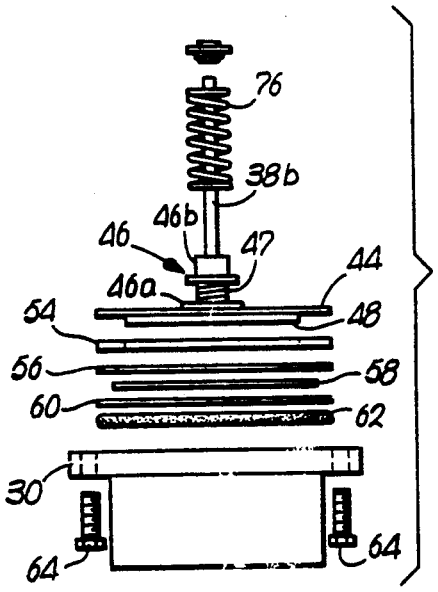
FIG. 4 is an exploded schematic view of the lower portion of the detector illustrating the lower end of the diaphragm piston and the diaphragm assembly associated therewith.
Figure 3:
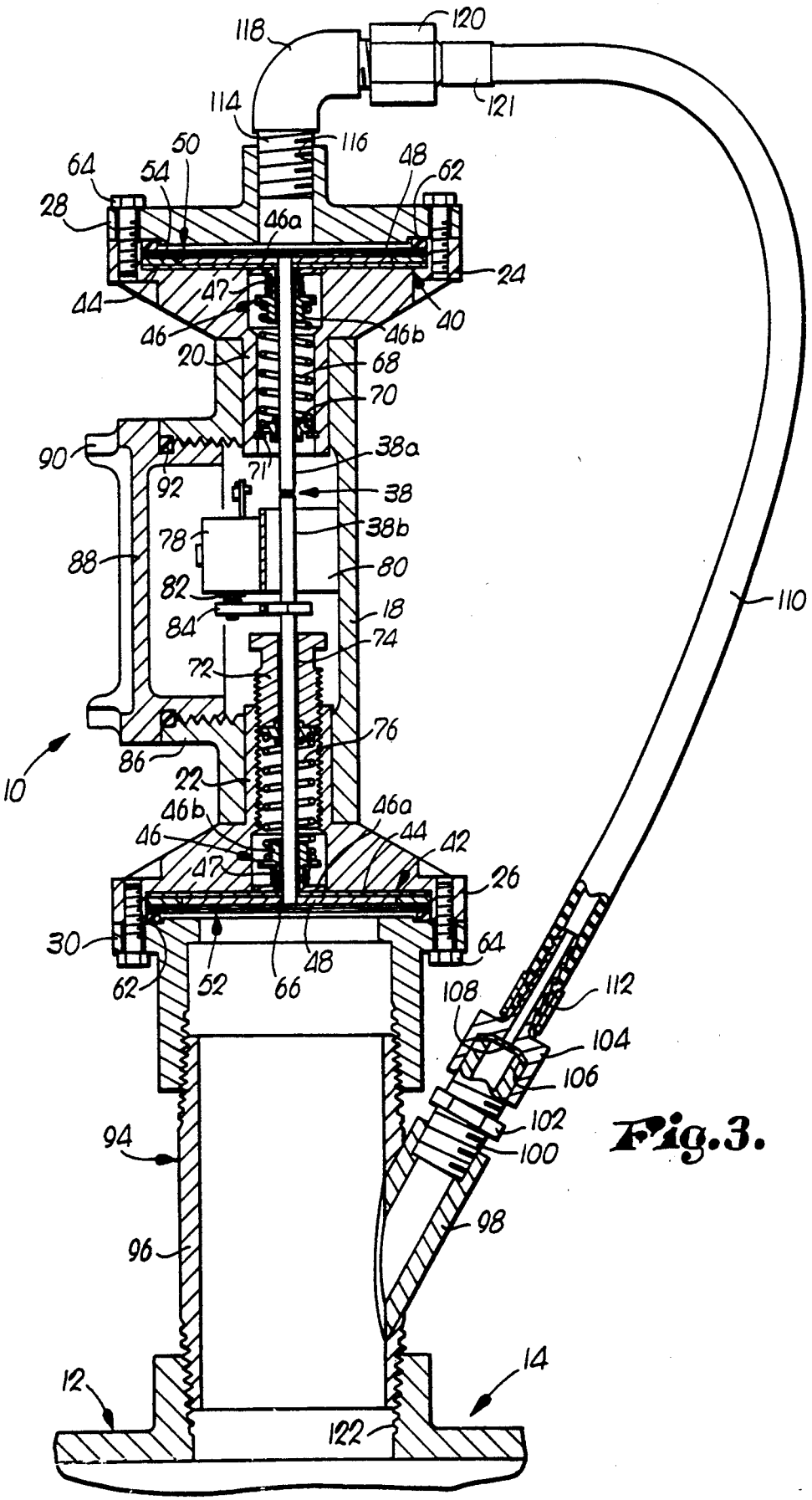
FIG. 3 is a vertical cross-sectional view of the detector and fragmentary system depicted in FIG. 2.

Referring to FIGS. 3 and 4, a double-ended piston unit 36 is mounted within housing 16 and consists of an elongated rod assembly 38 made up of two abutting rod segments **38*a* and 38*b* which extend through opposed, aligned tubular extensions 20 and 22. The outermost ends of segments 38*a* and 38*b* are connected to the central areas of respective pistons 40 and 42. Each of the pistons 40 and 42 includes a major disk plate 44 (see FIG. 4) connected to rod segments 38*a* and 38*b* of rod assembly 38. A spring coupling 46 around each of the rod segments 38*a* and 38*b* includes an outer flanged member 46*a* and an inner flanged member 46*b* which receive a spring 47 therebetween in surrounding relationship to a respective rod segments 38*a* or 38*b*. A smaller diameter outer disk 48 is secured to the normally outermost face of each disk plate 44**.

A sealing and diaphragm assembly 50 is provided outboard of piston 40 while a similar assembly 52 is outboard of piston 42. Each assembly 50 and 52 includes an inner metallic ring 54 which engages the innermost face of each major disk plate 44 of pistons 40 and 42 in surrounding relationship to a corresponding outer piston disk 48. An elastomeric disk 56 overlies each of the metallic rings 54 in covering relationship thereto. A smaller spacer disk 58 rests against the outer face of each elastomeric disk 56, while relatively thin metallic diaphragms 60 are outboard of each spacer disk 58. An elastomeric O-ring 62 seals the outer peripheral edge of each of the diaphragms 60 and is of a diameter approximately equal to the O.D. of each diaphragm 60. Although diaphragm 60 may be fabricated of various materials, stainless steel is preferred in this respect because of its corrosion resistance. End fittings 28 and 30 are secured to respective tubular extensions 20 and 22 by a series of threaded fasteners 64.

It can be seen from FIG. 3 that the sealing and diaphragm assemblies 50 and 52 fit within an internal cavity 66 within the outermost extremity of each of the flange sections 24 and 26. O-rings 62 are compressed between each of the diaphragms 60 and an opposed end fitting 28 or 30 to seal the diaphragms against leakage of fluid.

Extensions 20 and 22 project toward the central portion of body 18 in coaxial relationship with the rod assembly 38. A coil spring 68 is trapped in the bore of extension 20 between the outer flanged member **46*a* of the adjacent spring coupling 46 and a circular stop 70 secured to the tubular extension 20 by a ring 71**.

The extension 22 receives an externally threaded sleeve 72 which is adjustably threaded into the internally threaded bore of extension 22. Sleeve 72 has a central passage 74 therethrough which slidably receives the rod assembly member 38. A coil spring 76 is trapped between the innermost end of sleeve 72 and the inner flanged member 46*b* of lower spring coupling 46.

An electrical switch 78 within housing 16 is supported by a bracket 80 secured to the inner surface of housing 16. The contact actuator 82 of switch 78 is disposed to be engaged by a switch actuator component 84 adjustably affixed to rod assembly member 38*b* intermediate the ends thereof.

The body 18 of housing 16 has an internally threaded cylindrical section 86 which removably receives an externally threaded closure plate 88 provided with projections 90 on the outer face thereof for facilitating unscrewing of plate 88 from body 18. An O-ring 92 provides a seal between the outer extremity of cylindrical section 86 and closure plate 88.

A T-fitting 94 having external threads on opposite ends of the major leg 96 thereof is threaded into the outer internally threaded extremity of fitting 30. The integral, angled tubular leg segment 98 of fitting 94 communicates directly with the interior of the main leg 96 of fitting 94.

A double-ended externally threaded nipple 100 with a centrally located wrench flat 102 is threaded into the outer end of internally threaded leg segment 98. A coupling 104 is threaded over the outermost externally threaded end of nipple 100 and serves to trap a restriction plate 106 within coupling 104 and against the outer extremity of nipple 100. Plate 106 has an orifice 108 therein which is nominally about 0.030 in diameter. A projection from coupling 104 is telescoped into a flexible conduit 110 while a compression sleeve 112 is crimped into frictional engagement with the conduit 110 to hold the latter on the extension of coupling 104.

Another externally threaded nipple 114 is threaded into the internally threaded central aperture 116 of end fitting 28. An elbow connector 118 is threadably joined to the outer threaded section of nipple 114. The opposite end of connector 118 is joined to the upper end of conduit 110 by a coupling 120 threaded into the outermost extremity of the elbow connector 118. Another compression sleeve 121 secures conduit 110 to a hollow projection extending outwardly from coupling 120.

Figure 1:
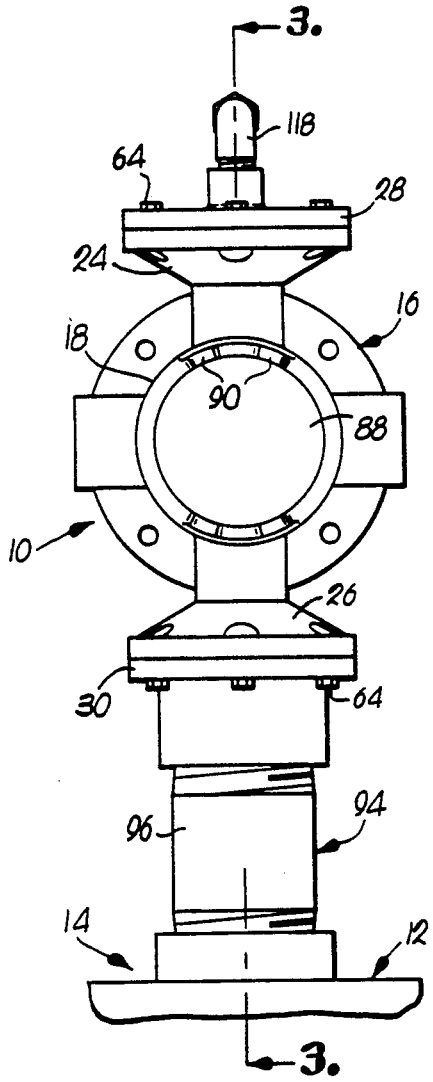
FIG. 1 is a front elevational view of a sudden pressure rise detector embodying the principles of the present invention shown mounted in place on a vessel or pipe illustrated fragmentarily and forming a part of a low pressure containment system protected by explosion suppression or isolation equipment.

It is also apparent from FIGS. 1-3 that the lower externally threaded section of leg 96 of T-fitting 94 is threadably connected to the internally threaded opening 122 of containment system 14.

The sudden rise pressure detector 10 is preferably of the type where the pressure setting for deflection of the rod assembly 38 to an extent that switch 78 is actuated by the switch actuator component 84 occurs within a setting of +2.5" to 45" w.c. The overpressure range should be in the order of 200 psig. The maximum vacuum service pressure should be at least −15" w.c. The detector should also be able to withstand a maximum continuous process temperature of at least about 200° F. and a maximum ambient temperature of at least about 180° F. The "wetted" metal components of the detector exposed to process conditions should be nickel-plated carbon steel, all elastomeric elements should be Buna N or equivalent, and the diaphragms should be 316 stainless steel or equal.

OPERATION

In operation, mounting of the detector 10 on the component 12 of containment system 14 as illustrated in the drawings permits sensing of the pressure at a single point in the associated containment vessel or structure. By virtue of the provision of pressure equalization conduit 110 extending between opposed outermost faces of the sealing and diaphragm assemblies 50 and 52, there is no relative movement of the piston unit 36 within housing 16 notwithstanding normal fluctuations in pressure in the containment system.

However, in the event of a fire or other event which signals the commencement of an incipient explosion, a very rapid rise of pressure in system 14 takes place causing a pressure wave or sudden rise of pressure to be immediately imposed against the lower sealing and diaphragm assembly 52. The sudden increase in pressure is not immediately and directly imposed on sealing and diaphragm assembly 50 however because of the small opening in restriction plate 106 which limits flow of fluid through line 110 into the cavity 66 of end plate 28. As a consequence, the lower diaphragm 60 of assembly 52 is deflected upwardly to shift rod assembly 38 along its longitudinal axis against the action of springs 68 and 76. Upward movement of rod assembly 38 causes the component 84 to shift the switch actuator 82 through a displacement to change the contacts of the normally closed, single pole double-throw switch 78.

Switch 78 is connected to the system in a manner to either illuminate an alarm light, sound an audible alarm, turn off one or more blower motors, initiate explosion suppression or isolation apparatus, or activate two or more of these functions simultaneously.

Detector 10 provides the advantageous feature of being able to detect an incipient explosion very early in the event to provide a useful electrical signal for explosion suppression or isolation, as well as an alarm of the conditions occurring, even though there must be a differentiation and distinction between normal pressure fluctuations and that which occurs as a result of the commencement of what would otherwise be a catastrophic event. A simple pressure detector of the type long in use in association with explosion detection systems does not give equivalent results because there is no means provided to compensate for normal fluctuations in pressure. Accordingly, the detector must be set in a manner such that it is not triggered until a significant pressure has been sensed well above normal pressure fluctuations encountered during operation of the containment system. The present detector overcomes the disadvantages and limitations of prior explosion protection pressure detectors by virtue of the fact that the sudden rise in pressure causes switch 78 to be actuated as described, at a point in time which is still within the normal pressure variation specifications for a particular system. Desirable suppression and isolation of explosions is accomplished by initiating such suppression or isolation at the earliest possible in the time span of the event.

It is known that the pressure rise from an explosion follows a parabolic curve which on a time/pressure basis demonstrates that although initially relatively flat, pressure rises very rapidly as time progresses. Accordingly, it is essential that the presence of a sudden rise in pressure be detected as soon as possible in order to effectively suppress or isolate the explosion.

We claim:

1. Apparatus which activates explosion suppression or isolation equipment and which detects a sudden incipient rise in pressure which could result in a destructive overpressure in a containment system subject to pressure fluctuations during normal operation, said containment system including wall structure defining a region to be protected, said apparatus attached to said containment system and comprising:

a housing having a first passage provided with means defining a fluid inlet adapted to be connected to the pressurized system at one area thereof;

a first movable closure means in said first passage which is shiftable in response to application of a predetermined pressure against the one side of the closure means exposed through said first passage inlet to fluid pressure within the system at said area, said housing being provided with a second passage provided with means defining a fluid inlet;

a second movable closure means in said second passage which is shiftable in response to application of a predetermined pressure against the one side of the second closure means which is opposed to said one side of the first closure means exposed to fluid pressure within the system at said area;

a single pressure equalization conduit operably connected between said first passage and the inlet of said second passage and defining a fluid communication path therebetween to equalize the pressure on said one side of each of the closure means during said on said one side of each of the closure means during said normal pressure fluctuations of the system at said area, said single conduit being defined by wall structure different from said region-defining wall structure;

means defining a restriction orifice in said conduit between the first passage and said inlet of the second passage of an effective cross-sectional area to limit the rate at which said equalization occurs and thereby produce a difference in the fluid pressure against said one side of each of the closure means when the fluid pressure at said area of the system rises at a rate which could result in a destructive overpressure in the system; and switch means in the housing for activating said equipment responsive to a predetermined difference in pressure on said one side of each of the closure means which results in movement of at least one of the closure means to a preselected extent.

2. Sudden pressure rise detector apparatus as set forth in claim 1, wherein said orifice restriction means comprises a plate spanning the conduit and having an opening therein substantially less than the cross-sectional area of the conduit.

3. Sudden pressure rise detector apparatus as set forth in claim 2, wherein said restriction plate has an opening therein of the order of 0.030 inch.

4. Sudden pressure rise detector apparatus as set forth in claim 1, wherein said closure means each comprise a deflectable diaphragm in a corresponding housing passage.

5. Sudden pressure rise detector apparatus as set forth in claim 4, wherein is provided connecting means extending between the deflectable diaphragms and movable with each of the latter, said equipment activating switch means within the housing being cooperable with said connecting means for activating the equipment in response to a predetermined shifting of the member.

6. Sudden pressure rise detector apparatus as set forth in claim 5, wherein said deflectable diaphragms are mounted at opposite ends of the housing in generally parallel relationship, said connecting means extending between and positioned for longitudinal shifting thereof in response to deflection of at least one of the diaphragms.

7. Sudden pressure rise detector apparatus as set forth in claim 6, wherein said equipment activating means includes an electrical switch having an actuating element, said connecting means being provided with a component thereon disposed to engage the actuating element of the switch when the connecting means is shifted through a predetermined displacement upon deflection of one of the diaphragms.

8. Sudden pressure rise detector apparatus as set forth in claim 7, wherein is provided means associated with the deflectable diaphragms for adjusting the amount of fluid pressure that must be applied to said one side of a respective diaphragm before deflection thereof occurs to an extent that the component on the connecting means will engage the actuating element of the switch and operate the latter to initiate operation of the suppression or isolation equipment.

9. Sudden pressure rise detector apparatus as set forth in claim 8, wherein said diaphragm deflection control means includes spring means operable to control the extent of deflection of a respective diaphragm upon application of a predetermined fluid pressure on said one side thereof.

10. Sudden pressure rise detector apparatus as set forth in claim 9, wherein the spring means is functional to permit adjustment of the pressure that must be applied to said one side of at least one of the diaphragms to deflect the latter and move the connecting means to an extent to cause actuation of the switch means.

11. Sudden pressure rise detector apparatus as set forth in claim 10, wherein said control means includes components for establishing a difference in the amount of pressure which must be applied to one of the diaphragms as compared with the pressure against the other diaphragm to cause movement of the connecting means through a displacement to effect actuation of the switch.

12. Sudden pressure rise detector apparatus as set forth in claim 11, wherein said control means is adjustable to permit establishment of a pressure differential on opposite sides of said diaphragms required to cause shifting of the connecting means through a displacement to effect actuation of the switch, of from about 2.5 inches of water column to about 45 inches of water column.

13. Sudden pressure rise detector apparatus as set forth in claim 11, wherein said apparatus is functional at a vacuum service pressure at least as low as −15 inches of water column.

14. Sudden pressure rise detector apparatus as set forth in claim 4, wherein said diaphragms are each fabricated of a relatively thin corrosion-resistant metallic material.

15. Sudden pressure rise detector apparatus as set forth in claim 14, wherein is provided a non-metallic flexible sheet member in engagement with the face of each metallic diaphragm opposed to the face thereof which receives fluid pressure thereon from the system.

* * * * *